US007178510B2

(12) United States Patent
Askew et al.

(10) Patent No.: US 7,178,510 B2
(45) Date of Patent: Feb. 20, 2007

(54) FUEL SYSTEM

(75) Inventors: James Martin Anderton Askew, Painswick (GB); Peter Derek Bogle, Cheltenham (GB)

(73) Assignee: Woodward Governor Company, Rockford, IL (US)

( * ) Notice: Subject to any disclaimer, the term of this patent is extended or adjusted under 35 U.S.C. 154(b) by 758 days.

(21) Appl. No.: 09/978,984

(22) Filed: Oct. 16, 2001

(65) Prior Publication Data

US 2002/0078739 A1 Jun. 27, 2002

(30) Foreign Application Priority Data

Oct. 16, 2000 (GB) ..... 0025349.2
Jun. 8, 2001 (GB) ..... 0113940.1

(51) Int. Cl.
*F02M 37/04* (2006.01)

(52) U.S. Cl. ..... 123/506; 123/496

(58) Field of Classification Search ..... 123/496, 123/506, 457, 458, 467, 501
See application file for complete search history.

(56) References Cited

U.S. PATENT DOCUMENTS 3,827,409 A 8/1974 O'Neill
4,612,893 A * 9/1986 Ishibashi et al. ..... 123/447
4,811,715 A * 3/1989 Djordjevic et al. ..... 123/447
4,881,504 A * 11/1989 Best ..... 123/447
4,940,037 A * 7/1990 Eckert ..... 123/506
5,042,445 A * 8/1991 Peters et al. ..... 123/446
5,176,120 A 1/1993 Takahashi
5,396,926 A 3/1995 Pataki et al. ..... 137/596.17
5,678,521 A 10/1997 Thompson et al. ..... 123/447
5,979,415 A * 11/1999 Sparks et al. ..... 123/506
6,019,091 A * 2/2000 Spoolstra ..... 123/496
6,085,727 A 7/2000 Nakano ..... 123/447
6,273,066 B1 * 8/2001 Frankle et al. ..... 123/446
6,308,689 B1 10/2001 Augustin
6,536,416 B1 * 3/2003 Mahr et al. ..... 123/506

FOREIGN PATENT DOCUMENTS

DE 38 02 161 A1 7/1989
GB 2 092 223 A 8/1982
GB 2 303 877 A 3/1997
GB 2 306 999 A 5/1997
JP 11-125140 11/1999
WO WO 96/41945 A1 12/1996

* cited by examiner

*Primary Examiner*—Carl S. Miller
(74) *Attorney, Agent, or Firm*—Gottlieb Rackman & Reisman

(57) ABSTRACT

A fuel system for use in an internal combustion engine, the fuel system comprising a source of high pressure fuel for supplying fuel through a single fuel supply path to an injector for injecting fuel, a first valve arrangement for controlling initiation of fuel injection and a second valve arrangement arranged in the fuel supply path, comprising a valve member which is operable between first and second positions to vary the rate of flow of fuel through the second valve arrangement, thereby to permit the fuel injection characteristics to be varied, in use.

15 Claims, 7 Drawing Sheets

Figure 4:
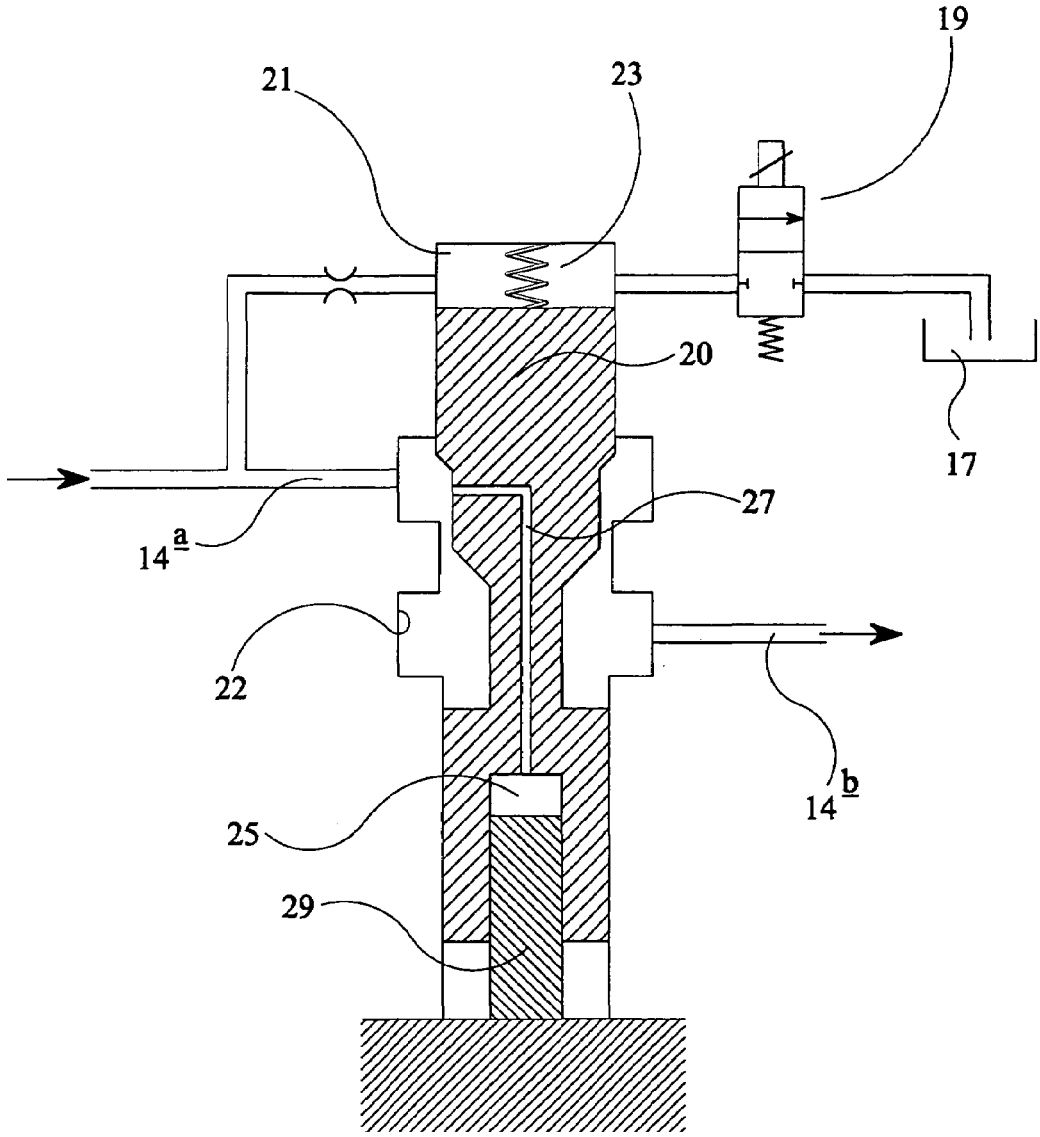

FIG 1
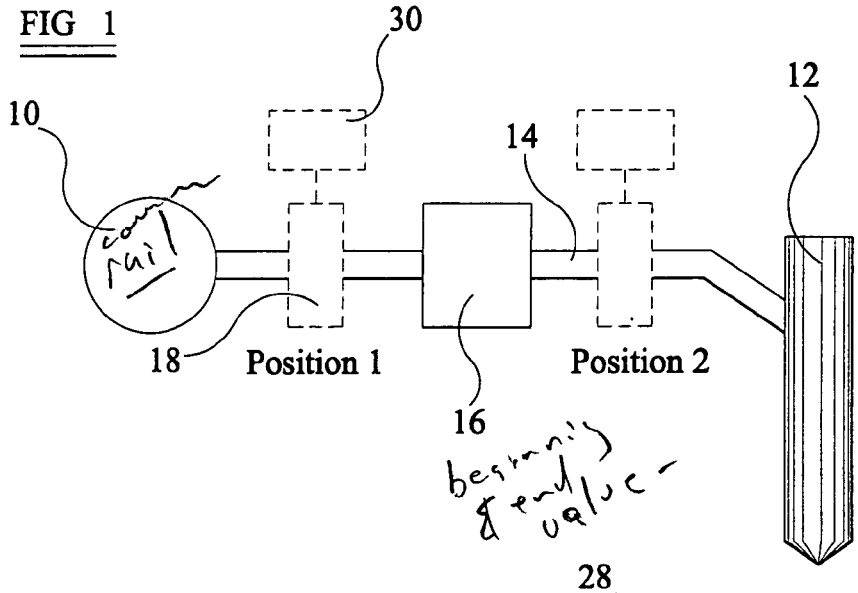
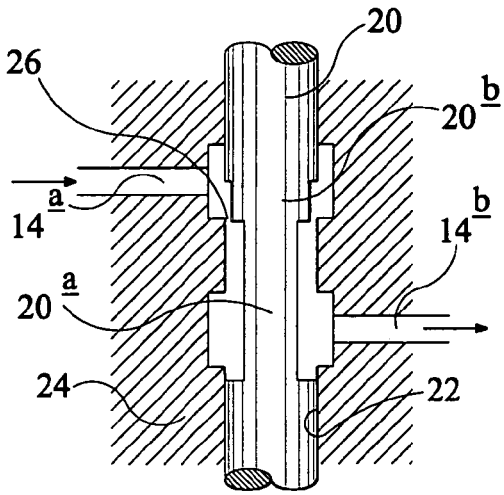
FIG 2
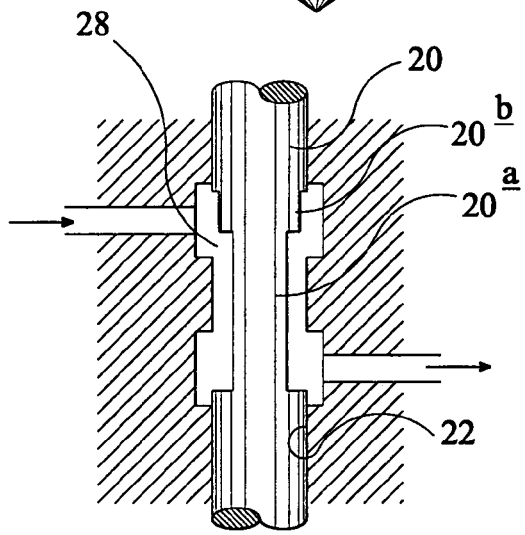
FIG 3
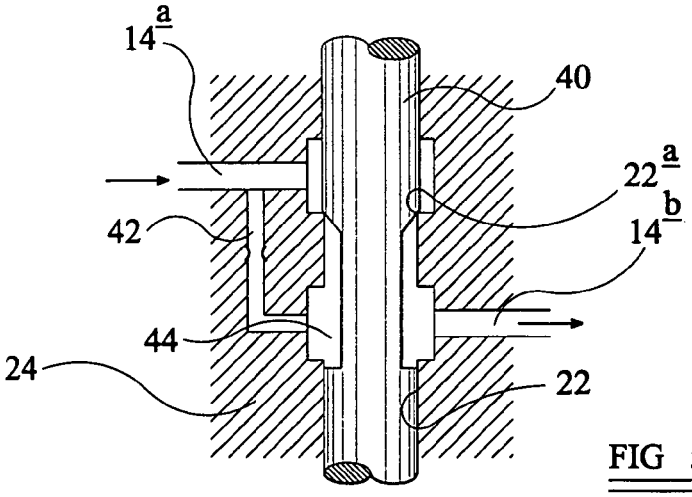
FIG 5

FIG 9 (a)
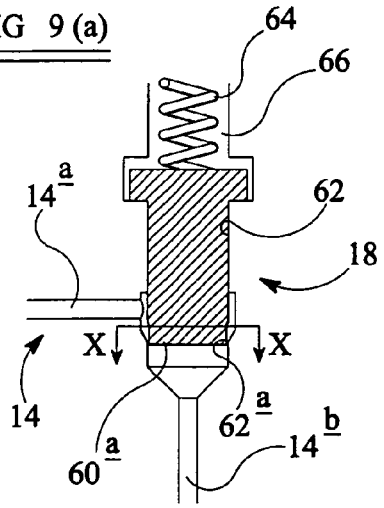
FIG 10
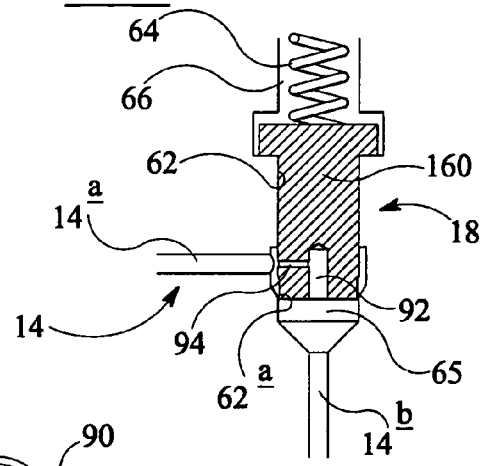
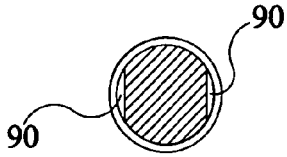
FIG 9 (b)
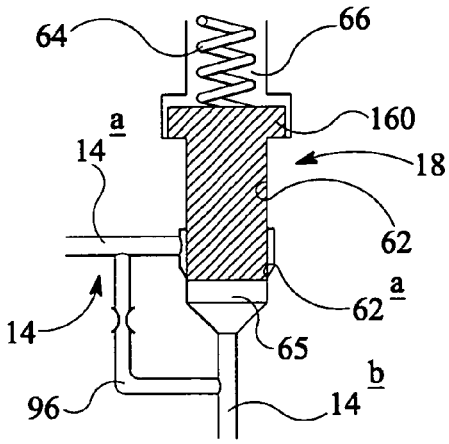
FIG 11
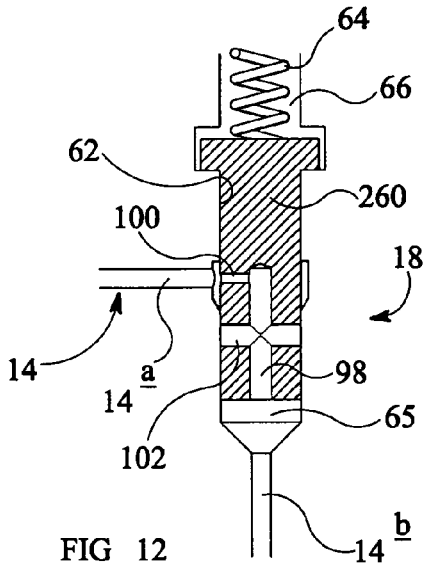
FIG 12

FUEL SYSTEM

The invention relates to a fuel system for use in supplying fuel to a combustion space of a compression ignition internal combustion engine. In particular, the invention relates to a common rail fuel system in which a common rail supplies fuel at high pressure to one or more injectors for injecting fuel into a combustion space of a compression ignition internal combustion engine.

In common rail fuel systems, it is known to control initiation and termination of injection by means of a valve arrangement arranged to control the supply of high pressure fuel along a supply path from the common rail to the injectors forming part of the fuel system. It is also known to control initiation and termination of injection directly by means of a control valve arrangement associated with the fuel injectors, for example by directly controlling movement of the valve needles forming part of the injectors. The control valve arrangement may be arranged to control valve needle movement by mechanical means or by hydraulic means.

By way of background to the present invention, DE 199 30 276 describes a common rail system in which a control valve is arranged within the high pressure fuel supply path to control the supply of fuel to the injectors.

In such systems, it is desirable to be able to vary the injection rate, and other fuel injection characteristics. WO 96/41945 describes a fuel system in which a fuel injection rate shaping device is provided to control the rate of flow of fuel into the engine. The fuel injection rate shaping device takes the form of one or more rate shaping transfer passages having predetermined lengths and diameters specifically designed to enable a selection of desired injection pressure rate shapes to be achieved. Fuel is supplied to the rate shaping transfer passages from an accumulator, and a valve arrangement is provided to select the transfer passage required to give the desired injection characteristics. One problem with the system is that the transfer passages must be of relatively long length. Additionally, it is necessary to provide a pressure damping device at the outlet of the accumulator to minimise pressure waves set up in the transfer passages.

It is an object of the present invention to provide an improved fuel system which enables the injection rate, or other fuel injection characteristics, to be varied, in use.

According to the present invention, there is provided a fuel system for use in an internal combustion engine, the fuel system comprising a source of high pressure fuel for supplying fuel to an injector through a fuel supply path having a substantially fixed flow length, a first valve arrangement for controlling initiation of fuel injection and a second valve arrangement comprising a valve member which is operable between first and second positions to vary the restriction to fuel flow through the second valve arrangement, thereby to vary the rate of flow of fuel to the injector so as to permit the fuel injection characteristics to be varied, in use.

Preferably, the source of fuel takes the form of a common rail charged with fuel at high pressure.

Preferably, the first valve arrangement is also arranged to control termination of fuel injection.

The first valve arrangement may be arranged within the fuel supply path or may be arranged to control operation of the fuel injector directly.

The fuel system may be arranged such that the valve member is moveable between a first position in which the flow of fuel to the injector is restricted and a second position in which the flow of fuel to the injector is substantially unrestricted, movement of the valve member between the first and second positions, in use, permitting the rate of flow of fuel through the second valve arrangement, to be supplied to the injector, to be varied.

The invention provides the advantage that the fuel injection characteristics, such as the fuel injection rate, can be varied. In particular, relatively low fuel injection rates can be controlled with improved accuracy.

The valve member of the second valve arrangement is preferably moveable within a bore provided in a valve housing.

In one embodiment of the invention, the second valve arrangement may take the form of a spool valve comprising a spool valve member.

The bore provided in the valve housing and the spool valve member may be shaped such that, when the spool valve member is in its first position, the bore and the spool valve member define a restricted flow path for fuel to be supplied to the injector and, when the spool valve member is in its second position, the bore and the spool valve member define a substantially unrestricted flow path for fuel to be supplied to the injector.

The spool valve member may be shaped such that it is of variable diameter along its axial length. For example, the spool valve member may include a first region of reduced diameter and a second region of enlarged diameter, whereby when the spool valve member is in the first position the enlarged diameter region defines, together with the bore, the restricted flow path and, when the spool valve member is in the second position the reduced diameter region defines, together with the bore, the substantially unrestricted flow path.

Alternatively, the spool valve member may be provided with flats, grooves or recesses which define, together with the bore, either the restricted flow path for fuel or the substantially unrestricted flow path for fuel depending on the position of the spool valve member.

In one embodiment, the valve member of the second valve arrangement is provided with an axially extending passage which communicates with a first radially extending passage of relatively small flow area, for example of relatively small diameter, and a second radially extending passage of larger flow area, the valve member being arranged such that, when it is in the first position, fuel flow through the second radially extending passage of larger flow area is substantially prevented and fuel is able to flow through the first radially extending passage into the axially extending passage, and when the valve member is in the second position fuel is able to flow through the second radially extending passage into the axially extending passage, thereby to permit the rate of flow of fuel through the second valve arrangement to be varied, in use, depending on the position of the valve member.

Preferably, the valve member may be urged towards the first position by means of a spring housed within a spring chamber for receiving fuel, the spring chamber communicating with a low pressure fuel reservoir through an additional restricted flow passage such that, upon movement of the valve member away from the first position under the influence of hydraulic pressure, fuel is displaced to the low pressure fuel reservoir through the additional restricted flow passage.

In an alternative embodiment of the invention, the second valve arrangement comprises a valve member which is engageable with a first seating to control the rate of flow of fuel supplied to the injector.

The valve member is conveniently arranged such that, when in the first position it is seated against the first seating to prevent the flow of fuel therepast and, when in the second position it is spaced away from the first seating such that the bore and the valve member define a substantially unrestricted flow path for fuel through which high pressure fuel flows to the injector.

The second valve arrangement preferably comprises a restricted flow path for fuel such that, when the valve member is in the first position, fuel flows through the restricted flow path to the injector.

The restricted flow path may be defined by a passage, or drilling, provided in the valve member. Alternatively, the restricted flow path may be defined by a passage or drilling provided in the valve housing. In a further alternative embodiment, the seating for the valve member, and/or the surface of the valve member which seats against the seating, may be shaped to define the restricted flow path.

The valve member may be enagageable with a second seating when in the second position, the valve member comprising an axially extending passage including a region of restricted diameter, whereby when the valve member is in the first position it is seated against the first seating such that fuel is unable to flow past the first seating but flows through the region of restricted diameter into the axially extending passage, and when the valve member is in the second position it is able to flow past the first seating into a further passage provided in the valve member which communicates with the axially extending passage downstream of the region of reduced diameter, thereby to define a substantially unrestricted by-pass flow path for fuel through the second valve arrangement.

The second valve arrangement may be actuable by means of an actuator arrangement. For example, the second valve arrangement may be actuable by means of an electromagnetic actuator arrangement.

Alternatively, the second valve arrangement may be actuable by means of hydraulic pressure acting on a surface associated with a valve member of the second valve arrangement to move the valve member between the first and second positions.

In one embodiment, the valve member of the second valve arrangement may urged towards the first position by means of a spring housed within a spring chamber for receiving fuel, the spring chamber communicating with a low pressure fuel reservoir through an additional restricted flow passage such that, upon movement of the valve member away from the first position under the influence of hydraulic pressure, fuel is displaced to the low pressure fuel reservoir through the additional restricted flow passage.

In one embodiment, the valve member of the second valve arrangement may be provided with an axially extending passage which communicates with a first radially extending passage or drilling of relatively small flow area and a second radially extending passage or drilling of larger flow area, whereby when the valve member is in the first position, fuel flow through the second radially extending passage of larger flow area is substantially prevented and fuel is able to flow through the first radially extending passage into the axially extending passage, and when the valve member is in the second position fuel is able to flow through the second radially extending passage into the axially extending passage, thereby to permit the rate of flow of fuel through the second valve arrangement to be varied, in use, depending on the position of the valve member.

Figure 6:
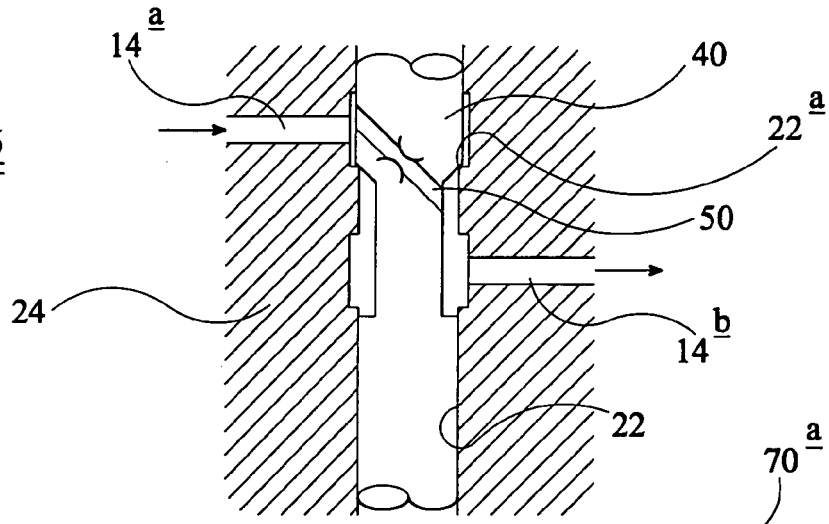
Figure 7:
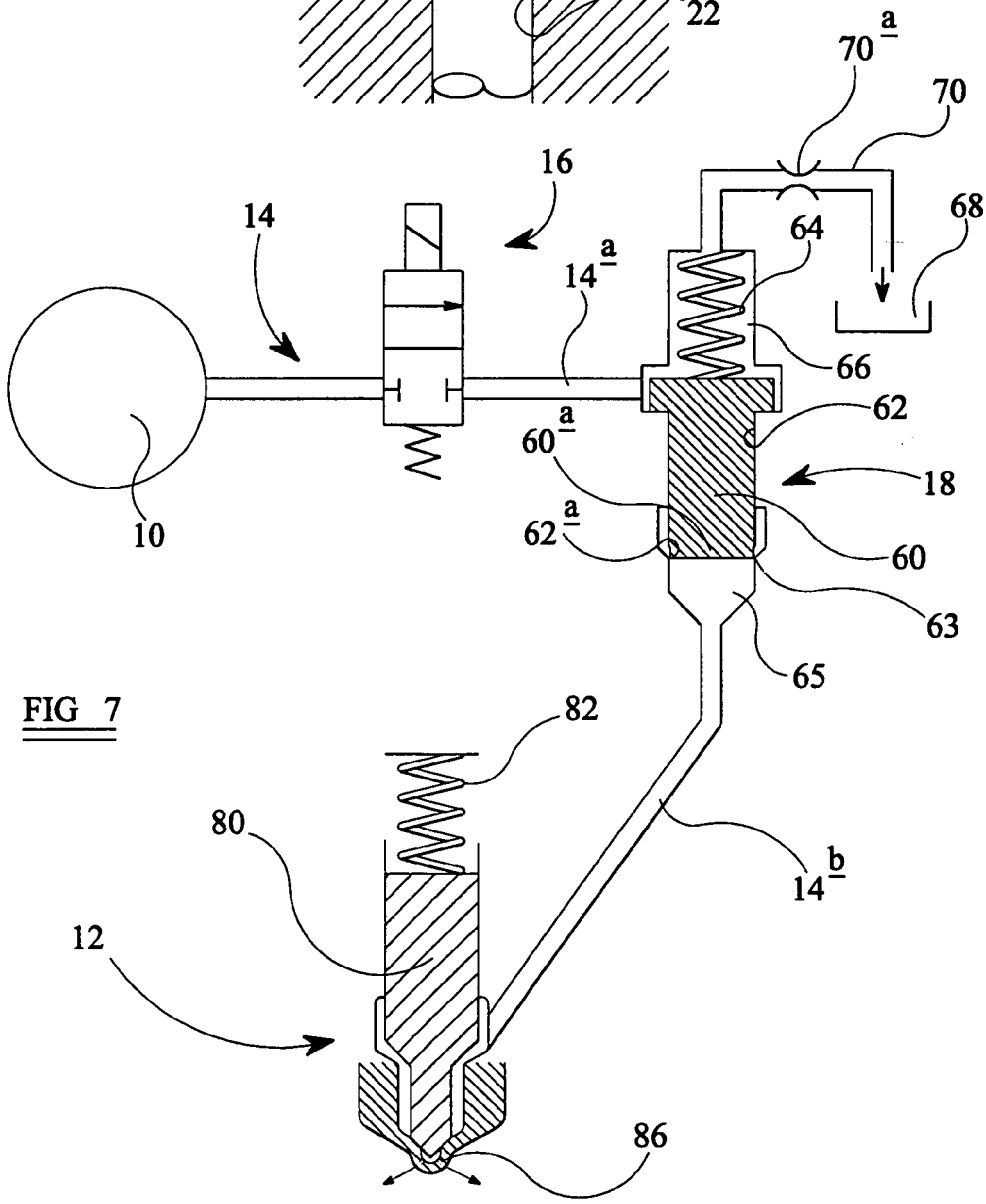
Figure 8:
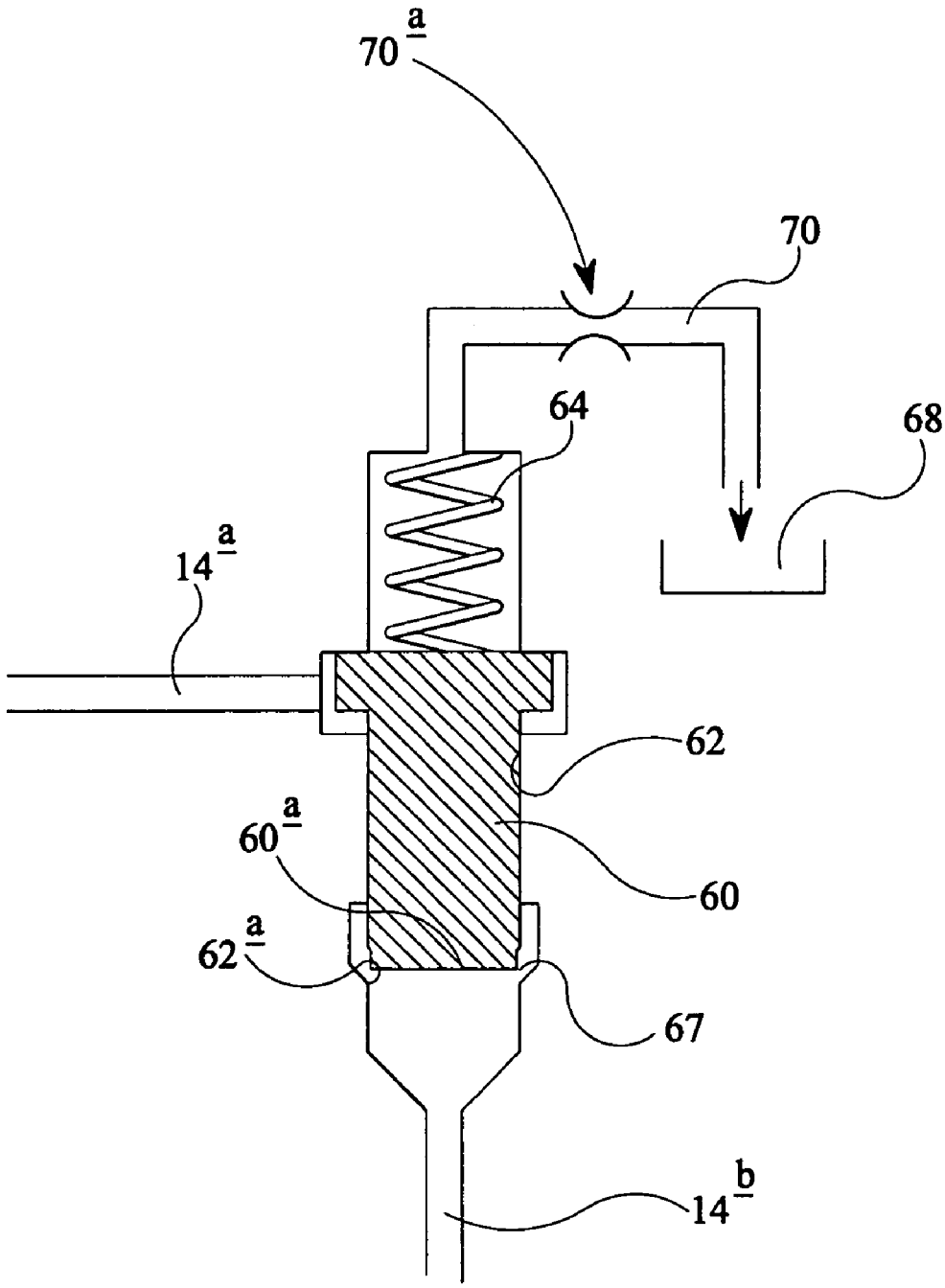
Figure 13:
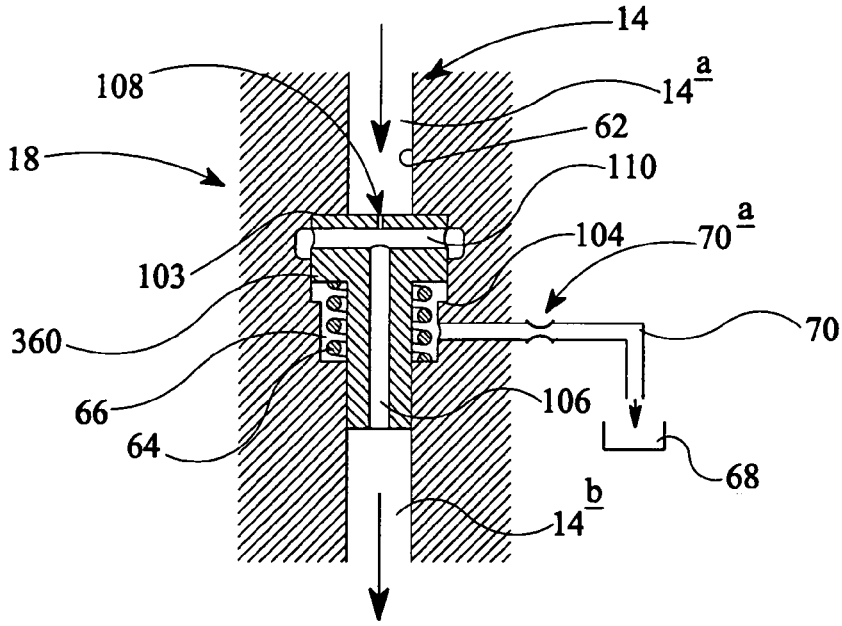
Figure 14:
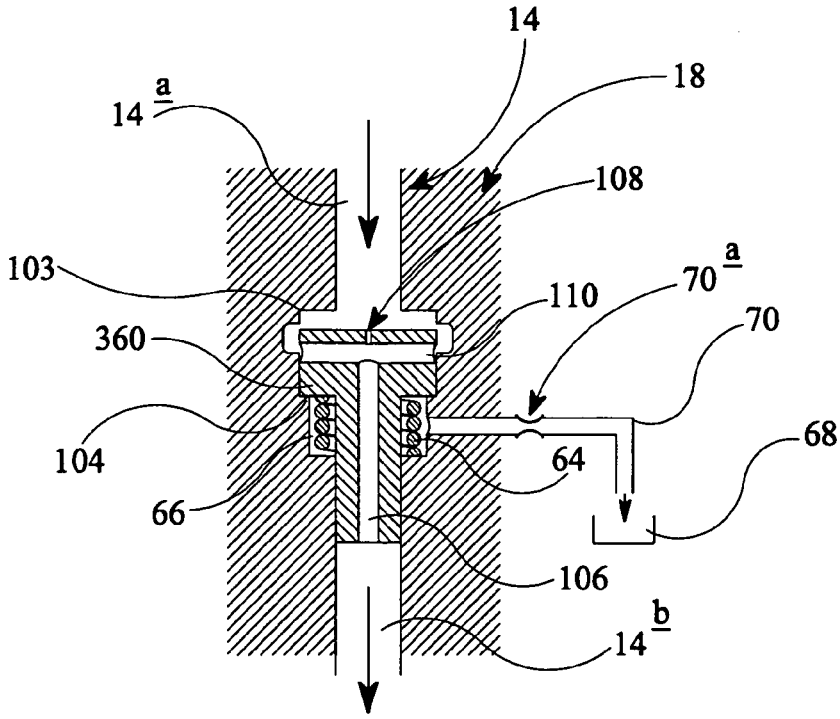
Figure 15:
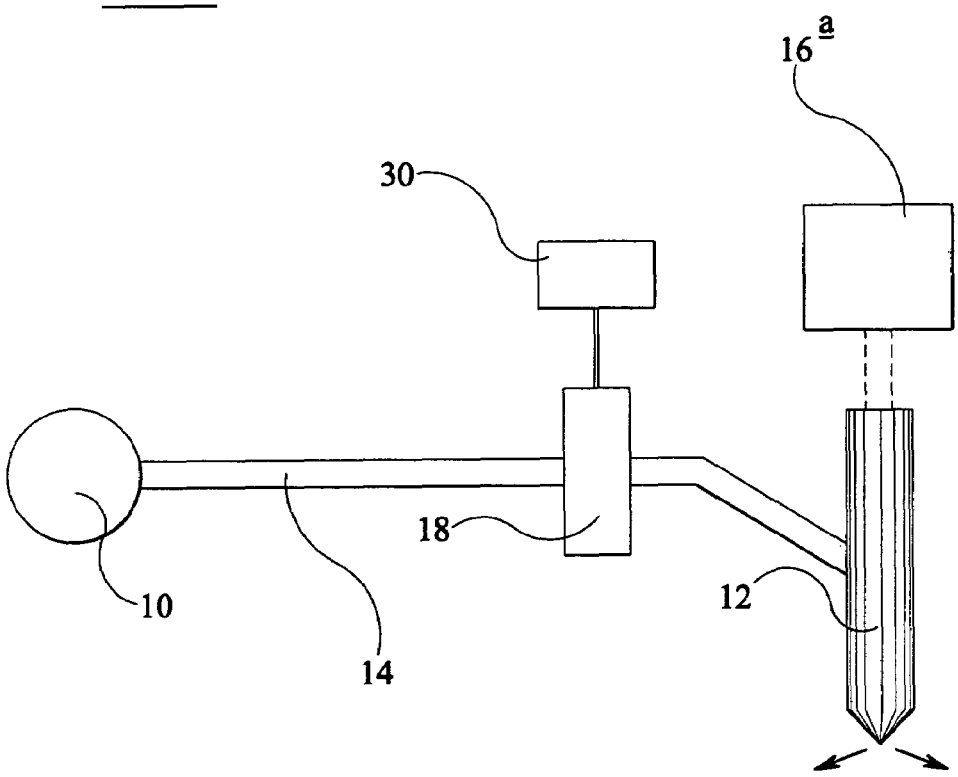

The invention will now be described, by way of example only, with reference to the accompanying drawings in which:

FIG. 1 is a schematic diagram of a fuel system in accordance with a first embodiment of the invention, FIGS. 2 and 3 show sectional views of a valve member forming part of the fuel system in FIG. 1 when in first and second positions respectively, FIG. 4 shows a sectional view of an alternative valve member which may form part of the fuel system in FIG. 1, FIGS. 5 and 6 show sectional views of alternative valve members which may form part of the fuel system in FIG. 1, FIGS. 7 and 8 show schematic views of an alternative fuel system to that shown in FIG. 1, when in first and second injecting states respectively, FIGS. 9 to 14 show sectional views of various alternative valve members for use in the fuel system in FIGS. 7 and 8, and FIG. 15 is a schematic diagram of a further alternative fuel system in accordance with the present invention.

Referring to FIG. 1, a common rail fuel system includes a common rail 10 charged with fuel at high pressure by means of a high pressure fuel pump (not shown) in a conventional manner. The common rail 10 delivers fuel to an injector 12 forming part of the fuel system. Fuel from the common rail 10 flows through a fuel supply path 14 which presents a fixed flow area to fuel flow therethrough and which has a fixed flow length through which fuel flows to the injector 12. A first valve arrangement 16 is arranged within the supply path 14, the first valve arrangement 16 taking the form of a main control valve. The fuel supply path 14 is also provided with a second valve arrangement 18 which takes the form of an injection rate control valve. The fuel supply path 14 includes an inlet region 14*a* arranged upstream of the injection rate control valve 18 and an outlet region 14*b* arranged downstream of the injection rate control valve 18. The rate control valve 18 may be located in the supply path 14 either in "Position 1" or in "Position 2", as indicated by the dashed lines.

In practice, the fuel system will include a plurality of injectors, depending on the number of engine cylinders in the associated engine, the common rail 10 supplying fuel at high pressure to each one of the injectors, in use. The main control valve 16 is operable to control the supply of fuel from the common rail 10 to the injector 12 in a conventional manner and, hence, controls the timing of initiation and termination of fuel injection. The injector 12 may be of the type in which the injection nozzle comprises a valve needle which is engageable with a valve needle seating to control fuel injection through one or more fuel injector outlets. When the pressure of fuel supplied to the injector 12 exceeds a predetermined amount, a force is applied to the valve needle which is sufficient to cause valve needle movement away from the seating so as to initiate injection. The rate of fuel injection by the injector 12 depends on both the dimensions of the injection nozzle and on the pressure of fuel supplied to the injection nozzle.

As shown in FIGS. 2 and 3, in a first embodiment of the present invention, the rate control valve 18 takes the form of a spool valve comprising a spool valve member 20 which is slidable within a bore 22 provided in a valve housing 24 to vary the restriction to the flow of fuel through the rate control valve 18. The spool valve member 20 is of variable diameter along its axial length such that it includes a first region 20*a* of reduced diameter and a second region 20*b* of slightly larger diameter. The spool valve member 20 is moveable between a first position (as shown in FIG. 2) in which the enlarged diameter region 20*b* of the spool valve member 20 and the adjacent part of the bore 22 define a restricted flow passage 26 for fuel. When the spool valve member 20 is moved to a second position (as shown in FIG. 3), the reduced diameter region 20*a* of the spool valve member 20 defines, together with the adjacent part of the bore 22, a substantially unrestricted flow passage 28 for fuel flowing through the rate control valve 18.

The rate control valve 18 may be controlled by means of an electromagnetic actuator arrangement 30 by supplying a variable current to a winding to control the force applied to the spool valve member 20 to cause movement thereof within the bore 22.

Operation of the main control valve arrangement 16 is conveniently controlled by means of an electromagnetic actuator arrangement (not shown). Operation of the main control valve arrangement 16 may be achieved directly by means of the electromagnetic actuator or may be controlled through a hydraulic link, as described previously with reference to control of the rate control valve 18.

In use, when it is desired to inject fuel from the injector 12 at a relatively low injection rate, the main control valve 16 is operated such that fuel is able to flow from the common rail 10, through the fuel supply path 14 to the injector 12. Upon opening of the main control valve 16, the pressure of fuel supplied to the injector 12 increases until such time as the valve needle forming part of the injector 12 is caused to lift from its seating to permit fuel to flow through the fuel injector outlets.

With the spool valve member 20 in the first position (as shown in FIG. 2), such that a substantial restriction to fuel flow is provided by the restricted flow passage 26, the pressure of fuel supplied through the supply path 14 to the injector 12 is reduced due to the presence of the restriction 26. As the fuel injection rate depends on fuel pressure within the injection nozzle, the rate of fuel injection is relatively low.

When it is desired to inject fuel at a higher rate, the rate control valve 18 is operated such that the spool valve member 20 moves to the second position in which the flow of fuel through the rate control valve 18 is substantially unrestricted. The pressure of fuel supplied to the injector 12 through the supply path 14 is therefore maintained at a relatively high level such that a relatively high rate of fuel injection is achieved.

By providing an additional control valve in the supply path 14, in addition to the main control valve 16, relatively low injection rates can be achieved and can be controlled with improved accuracy. It is known to control the injection rate by providing a three-position main control valve, in which movement of the valve between open, closed and partially closed positions enables a degree of control of the injection rate. However, it is difficult to control relatively low rates of fuel injection with accuracy using such systems. The present invention also provides the advantage that only a single fuel supply path 14 is required, the rate of fuel flow through the supply path 14 being controlled by varying the restriction to fuel flow through the rate control valve 18.

In an alternative embodiment (not shown) to that shown in FIGS. 2 and 3, the spool valve member 20 may be provided with flats, slots, grooves or recesses to enable the restriction to the flow of fuel to be varied depending on the position of the spool valve member 20.

Alternatively, and as shown in FIG. 4, the rate control valve 18 may be servo operated by means of a hydraulic link between an electromagnetically operated valve 19 and the rate control valve 18. The electromagnetically operated valve 19 controls communication between a low pressure fuel reservoir 17 and a first chamber 21 associated with one end of the spool valve member 20, the valve 19 being operable to control the force due to fuel pressure within the first chamber 21 which acts on the spool valve member 20. The force due to fuel pressure within the first chamber 21 acts, in combination with a force due to resilient bias means 23, against the force due to fuel pressure within a second chamber 25 defined by a recess provided in the spool valve member 20 and a surface of a static pin member 29. In use, fuel is supplied to the second chamber 25 through a drilling 27 provided in the spool valve member 20. It will be appreciated that the position of the spool valve member 20 within the bore 22 will be determined by the balance of hydraulic forces acting on the spool valve member 20 which, in turn, is determined by the state of the electromagnetically operated valve 19.

Referring to FIG. 5, there is shown a further alternative type of rate control valve 18 for use in the fuel system shown in FIG. 1. The rate control valve 18 comprises a valve member 40 which is engageable with a seating 22*a* defined by the bore 22 within which the valve member 40 is moveable to control the flow of fuel through the rate control valve 18. The valve housing 24 is provided with a drilling which defines a restricted flow passage 42 for fuel between the inlet region 14*a* of the fuel supply path 14 and an annular chamber 44 defined by the bore 22. The annual chamber 44 communicates with the outlet region 14*b* of the fuel supply path 14 such that, when the valve member 40 is in its seated position (as shown in FIG. 5), fuel flows through the restricted flow passage 42, into the annular chamber 44 and into the outlet region 14*b* of the fuel supply path 14 to the injector. With the valve member 40 in the first position, the pressure of fuel supplied to the injector 12 is reduced such that a lower fuel injection rate is achieved, as described previously.

The valve member 40 is moveable to a second position in which it is spaced away from the seating 22*a* such that a substantially unrestricted flow passage for fuel is defined between the valve member 40 and the seating 22*a*. With the valve member 40 spaced away from the seating 22*a*, the flow of fuel through the rate control valve 18 therefore bypasses the restricted flow passage 42 and is able to flow past the seating 22*a*, and through the outlet region 14*b* of the supply path 14 to the injector 12. When the valve member 40 is moved away from the seating 22*a*, the pressure of fuel supplied to the injector 12 is maintained at a relatively high pressure such that a higher injection rate is achieved. It will be appreciated that the restriction to fuel flow along the supply path 14 can be varied by controlling the position of the valve member 40 relative to the seating 22*a* such that relatively low fuel injection rates can be achieved and can be controlled accurately.

Referring to FIG. 6, in a further alternative embodiment, the rate control valve 18 includes a valve member 40 provided with a drilling 50 which defines a restricted flow passage for fuel. The valve member 40 is moveable between a first position, in which it is seated against the seating 22*a*, and a second position in which it is spaced away from the seating 22*a*, as described previously. When the valve member 40 is seated against the seating 22*a*, fuel delivered to the inlet region 14*a* of the supply path 14 flows through the drilling 50 provided in the valve member 40 such that the flow of fuel to the injector 12 is restricted. This results in a relatively low pressure of fuel being delivered to the injector such that a relatively low injection rate is achieved.

In order to increase the fuel injection rate, the valve member 40 is moved away from the seating 22*a* such that the drilling 50 is bypassed and the flow of fuel through the rate control valve 18 is substantially unrestricted. The pressure of fuel supplied to the injector is therefore relatively high, resulting in a higher injection rate.

In an alternative embodiment to those shown in FIGS. 5 and 6, the seating 22*a* for the valve member 40 may be shaped to define a restricted flow path for fuel when the valve member 40 is seated. Alternatively, or in addition, the surface of the valve member 40 which is engageable with the seating 22*a* may be shaped to define the restricted flow path.

An alternative embodiment of the fuel system is shown in FIG. 7, in which the rate control valve 18 takes the form of a spool valve which is operable hydraulically, rather than being operated by means of an actuator arrangement. The rate control valve 18 includes a spool valve member 60 including a region 60*a* of reduced diameter. The spool valve member 60 is slidable within a bore 62 including an enlarged diameter region in communication with the inlet region 14*a* of the fuel supply path 14, the bore further defining a surface 62*a* downstream of said enlarged region. The spool valve member 60 is movable between a first position (as shown in FIG. 7) in which a restricted flow path 63 for fuel is defined by the outer surface of the reduced diameter region 60*a* of the spool valve member 60 and the surface 62*a* of the bore 62, and a second position (as shown in FIG. 8) in which the spool valve member 60 is spaced away from the surface 62*a* to define, together with the enlarged region of the bore 62, a substantially unrestricted flow path 67 for fuel. The spool valve member 60 is urged into the first position by means of a first spring 64 which is arranged within a spring chamber 66 associated with one end of the spool valve member 60. The spring chamber 66 communicates with a low pressure fuel reservoir 68 through a flow passage 70 provided with a restriction 70*a*. A further chamber 65 is defined by the bore 62 in communication with the outlet region 14*b* of the fuel supply path 14.

The injector 12 is shown in further detail in FIG. 7 and includes a valve needle 80 which is urged towards a valve needle seating by means of a nozzle spring 82, movement of the valve needle 80 away from the valve needle seating against the force due to the nozzle spring 82 causing fuel delivered to the injector 12 to flow through one or more outlet openings 86 of the injector into the engine cylinder or other combustion space.

In use, when it is desired to inject fuel from the injector 12 at a relatively low injection rate, the main control valve 16 is operated such that fuel is able to flow from the common rail 10, through the fuel supply path 14 to the injector 12. Upon opening of the main control valve 16, the pressure of fuel supplied to the injector 12 increases until such time as the valve needle 80 is caused to lift from its seating, against the force due to the nozzle spring 82, to permit fuel to flow through the fuel injector outlet openings 86. With the spool valve member 60 in its first position (as shown in FIG. 7), such that the flow of fuel through the rate control valve 18 is restricted by means of the restricted flow path 63, the pressure of fuel supplied through the supply path 14 to the injector 12 is relatively low. In such circumstances, as the fuel injection rate from the injector 12 depends on the fuel pressure delivered to the injection nozzle, the rate of fuel injection is relatively low.

As the pressure of fuel delivered through the inlet region 14*a* to the further chamber 65 increases, the spool valve member 60 will be urged away from the first position into the second position (as shown in FIG. 8) against the force due to the first spring 64. Movement of the spool valve member 60 into the position shown in FIG. 8 will be delayed as fuel within the spring chamber 66 is displaced through the restricted flow passage 70, 70*a* to the low pressure fuel reservoir 68. Once the spool valve member 60 has moved into its second position, the rate of flow of fuel through rate control valve 18 will be substantially unrestricted, resulting in an increase in fuel pressure delivered to the injector 12 and, hence, an increase in the rate of fuel injection through the outlet openings 86.

When injection is to be terminated, the main control valve 16 is closed such that fuel is no longer supplied from the common rail 10 to the inlet region 14*a* of the supply path 14. Fuel pressure within the inlet and outlet regions 14*a*, 14*b* of the fuel supply path 14 is therefore reduced and the valve needle 80 is urged against the valve needle seating by means of the nozzle spring 82. The pressure of fuel within the inlet and outlet regions 14*a* 14*b* of the fuel supply path 14, and the pressure of fuel within the injector 80, is reduced further as fuel is able to leak to low pressure through valve clearances in one or more of the valve arrangements 16, 18 and/or the injector 12. As the pressure of fuel acting on the spool valve member 60 to urge the spool valve member 60 away from the surface 62*a* is reduced, the spool valve member 60 is returned to the first position (as shown in FIG. 7) under the action of the first spring 64 and a force due to fuel which flows back through the restricted flow passage 70, 70*a* into the spring chamber 66. In practice, it may be necessary to slightly pressurise the low pressure reservoir 68 to ensure the spring chamber 66 is pressurised to a sufficient level, ready for the next injection cycle.

FIGS. 9(*a*) and 9(*b*) show different sectional views of an alternative type of rate control valve 18 for use in the fuel system shown in FIG. 7. As can be seen most clearly in FIG. 9(*b*), one end of the spool valve member 60 is provided with laterally opposed flats 90. Depending upon the position of the spool valve member 60 within the bore 62, either the flattened regions 90 of the spool valve member 60 cooperate with the surface 62*a* of the bore 62 to define a restricted flow path for fuel between the inlet region 14*a* and the outlet region 14*b*, or the spool valve member 60 is spaced away from the surface 62*a* to define a substantially unrestricted flow path for fuel between the inlet region 14*a* and the outlet region 14*b*. Operation of the fuel system is similar to that described previously with reference to FIGS. 7 and 8 and so will not be described in further detail hereinafter.

FIGS. 10 to 12 show further alternative forms of the rate control valve 18 for use in the fuel system of FIG. 7. In FIG. 10, the valve member 160 is provided with a drilling which defines a first, axially extending passage 92 which communicates, at one end, with the further chamber 65. The other end of the axially extending passage 92 communicates with a further drilling which defines a radially extending passage 94 of restricted diameter. The valve member 160 is shaped, at its lowermost end, to cooperate with the surface 62*a* such that, when in a first position in which the valve member 160 is adjacent the surface 62*a*, fuel is substantially prevented from flowing past the surface 62*a* into the further chamber 65 but is able to flow through the restricted passage 94, into the axially extending passage 92 and, hence, into the outlet region 14*b* for delivery to the injector 12. In such circumstances, the rate of flow of fuel through the supply path 14 to the injector 12 is relatively low such that the rate of fuel injection through the outlet openings 86 of the injector 12 will be relatively low.

As fuel pressure within the further chamber 65 increases, the valve member 160 will be urged away from the surface 62*a* due to increased hydraulic forces acting on the valve member 160, against the force due to the first spring 64, thereby displacing fuel within the spring chamber 66 through the restricted passage 70, 70*a* and to the low pressure fuel reservoir 68 and permitting fuel to flow through a relatively unrestricted flow path defined between the valve member 160 and the surface 62*a* to the injector 12. After an initial period of time during which the valve member 160 displaces fuel within the spring chamber 66 to the low pressure fuel reservoir 68, the rate of flow of fuel through the supply path 14 to the injector 12 will be increased, resulting in a higher rate of fuel injection through the outlet openings 86 of the injector 12.

The rate control valve 18 in FIG. 11 operates in a similar way to the rate control valve shown in FIG. 10 except that, when the valve member 160 is in its first position in which cooperation between the valve member 160 and the surface 62*a* substantially prevents the flow of fuel from the inlet region 14*a* to the further chamber 65, the restricted flow path for fuel is defined by a drilling provided in a housing which defines a restricted flow passage 96.

FIG. 12 shows a further alternative rate control valve 18 in the form of a spool valve, including a spool valve member 260 of increased axial length. The spool valve member 260 is provided with a drilling which defines an axially extending passage 98 of relatively large diameter through which fuel flows at a relatively unrestricted rate, a further drilling which defines a first transverse passage 102 of substantially unrestricted diameter through which fuel flows at a relatively unrestricted rate and an additional drilling which defines a radially extending passage 100 of a relatively small diameter through which fuel flows at a restricted rate.

In the position shown in FIG. 12, fuel delivered to the inlet region 14*a* of the fuel supply path 14 is able to flow through a restricted flow path defined by the radially extending passage 100 and the axially extending passage 98 to the outlet region 14*b* of the supply path 14 and, hence, to the injector 12. As the spool valve member 260 is urged in an upward direction (in the illustration shown in FIG. 12) against the force due to the first spring 64, due to hydraulic pressure acting on the valve member 260, the spool valve member 260 is moved to a second position in which the fuel within the inlet region 14*a* of the supply path 14 is able to flow through the first transverse passage 102 of unrestricted diameter, into a region of the axially extending passage 98 downstream of the point of communication with the radially extending passage 100 and, hence, into the outlet region 14*b* for delivery to the injector 12. Thus, when the spool valve member 260 is in the second position, the flow of fuel to the injector 12 through the rate control valve 18 is substantially unrestricted such that an increased rate of fuel injection through the outlet openings 86 is achieved. The spool valve member 260 may be configured such that the flow of fuel through the first radially extending passage 100 is prevented when the valve member 260 is in the second position, but this is not essential.

For any of the rate control valves 18 shown in FIGS. 7 to 12, the flow of fuel through the rate control valve 18 may be in the reverse direction such that the 'outlet region' 14*b* communicates with the common rail 10 and the 'inlet' region 14*a* delivers fuel to the injector 12. Thus, when the pressure of fuel delivered to the inlet side of the rate control valve 18 (i.e. the outlet region 14*b*) increases, the valve member 60 is urged away from a first position, in which a restricted flow path for fuel is defined in the fuel supply path 14, into a second position in which the rate of flow of fuel to the injector 12 is substantially restricted.

FIGS. 13 and 14 show a still further alternative form of the rate control valve 18 in which the valve member 360 is arranged within an axially extending fuel supply path 14. The supply path 14 is shaped to define first and second stepped surfaces 103, 104 respectively with which the valve member 360 is engagable when in its first and second operating positions respectively. The fuel supply path 14 is also shaped to include an enlarged region which defines the spring chamber 66 within which the first spring 64 is arranged to urge the valve member 360 into the first position in which it engages the first stepped surface 103. The valve member 360 is provided with an axially extending passage 106 which communicates, at one end, with the outlet region 14*b* of the supply path 14 and which includes, at the other end, a region 108 having a relatively small flow area in communication with the inlet region 14*a* of the supply path 14. The valve member 360 is also provided with a radially extending passage 110 which presents a substantially unrestricted flow area to fuel, the radially extending passage 110 being in communication with the axially extending passage 106 downstream of the restricted region 108.

When the valve member 360 is in its first position (as shown in FIG. 13), the upper end of the valve member 360 is in engagement with the first stepped surface 103 such that fuel within the inlet region 14*a* is unable to flow past the first stepped surface 103 into the radially extending passage 110 but flows through the restricted region 108, into the axially extending passage 106 and to the outlet region 14*b* for delivery to the injector 12. The rate of flow of fuel to the injector 12 is therefore relatively low such that a relatively low rate of fuel injection is achieved, as described previously.

As fuel pressure within the inlet region 14*a* of the supply path 14 increases, the valve member 360 will be urged away from the first stepped surface 103, against the force due to the first spring 64 and also against increased fuel pressure within the spring chamber 66, due to the increased hydraulic force applied to the upper end surface of the valve member 360. The valve member 360 is urged into engagement with the second stepped surface 104 (as shown in FIG. 14) such that fuel within the inlet region 14*a* is able to flow past the first stepped surface 103, by-passing the restricted region 108, and into the transverse passage 110 of substantially unrestricted diameter. Under such circumstances, the rate of flow of fuel through the supply path 14 is substantially unrestricted such that the rate of fuel injection through the outlet openings 86 of the injector 12 is relatively high, as described previously. Movement of the valve member 360 into the position shown in FIG. 14 will be delayed slightly, as for previously described embodiments, as fuel within the spring chamber 66 is displaced through the restricted flow passage 70, 70*a* to the low pressure fuel reservoir 68.

The flow of fuel through the rate control valve 18 may also be reversed in the embodiments shown in FIGS. 13 and 14, as discussed previously.

FIG. 15 shows a further alternative embodiment of the invention in which the rate control valve 18 is arranged within the fuel supply path 14, but in which initiation and termination of fuel injection by the injector 12 is controlled directly by means of a control valve 16*a*. The rate control valve 18 in FIG. 15 may take the form of any of the valve arrangements shown in FIGS. 2 to 6. Typically, the main control valve 16*a* may take the form of an electromagnetic actuator arrangement for controlling movement of a valve needle of the injector 12 directly or by hydraulic means in a manner which would be familiar to a person skilled in the art. As described previously, initiation and termination of injection is controlled by operating the control valve 16*a*, and the injection rate is controlled by controlling operation of the rate control valve 18.

The invention provides a means for controlling the initiation and duration of the relatively low rate portion of fuel injection either using a solenoid (as shown in FIGS. 2 to 6), or preset (as shown in FIGS. 7 to 14). In some circumstances, for example for some combinations of engine speed, load and timing, it may be desirable for injection at relatively low rates to be avoided. In such circumstances, when solenoid controlled, the valve member of the rate control valve 18 can be maintained in a position in which the flow of fuel to the injector 12 is substantially unrestricted. Alternatively, it may be desirable to have a low injection rate of relatively long duration and this can be achieved by maintaining the valve member in the position which restricts the flow of fuel to the injector 12 for a relatively long period. For the embodiments shown in FIGS. 7 to 14, where the rate control valve 18 is controlled hydraulically, the dimensions of the valve member 60, 160, 260, 360 and of the restriction 70*a* and the size of the first spring 64 are selected to ensure the desired injection characteristics are achieved.

It is an important aspect of the present invention that the fuel supply path 14 has a fixed flow length through which fuel flows from the common rail 10 to the injector 12. It will be appreciated that although movement of the valve member 20, 40, 60, 160, 260, 360 may alter the actual path through which fuel flows (for example, through the drilling 96 or past the surface 62*a* in FIG. 11), this does not substantially alter the flow length of the supply path and such 'redirecting' of the flow only alters the rate at which fuel flows to the injector 12 by varying the restriction to fuel flow. It will also be appreciated that the fuel supply path 14 may branch into two or more separate paths whilst still maintaining a fixed flow length between the common rail 10 and the injector 12.

Although the embodiments of the invention are described as common rail fuel systems, it will be appreciated that the fuel source 10 may take an alternative form.

The invention claimed is:

1. A fuel system for use in an internal combustion engine comprising:

a fuel injector having an outlet nozzle for injecting fuel for combustion in said engine;

a source of high pressure fuel for supplying fuel to said injector outlet nozzle through a fuel supply path having a substantially fixed flow length;

a first valve arrangement in said fuel supply path for controlling initiation of fuel injection in an injection cycle;

a second valve arrangement in said fuel supply path including a valve member which is operable between first and second positions to vary the restriction to fuel flow through the second valve arrangement to vary the rate of flow of fuel to the injector outer nozzle wherein the variation of flow rate of fuel to the injector outlet nozzle throughout said injection cucle follows an injection characteristic, and an actuator for controlling the operation of the second valve arrangement throughout said injection cycle to vary a time dependent fuel injection characteristic defined by the variation of fuel injection rate throughout said injection cycle.

2. The fuel system as claimed in claim 1, wherein the source of fuel takes the form of a common rail charged with fuel at high pressure.

3. The fuel system as claimed in claim 1, wherein the first valve arrangement is also arranged to control tennination of fuel injection.

4. The fuel system as claimed in claim 1, wherein the second valve arrangement is arranged such that, when the valve member is in the first position, the flow of fuel through the second valve arrangement is restricted and, when the valve member is in the second position, the flow of fuel through the second valve arrangement is substantially unrestricted, operation of the actuator to move the valve member between the first and second positions, in use, permitting the rate of flow of fuel supplied to the injector to be varied.

5. The fuel system as claimed in claim 1, wherein the valve member of the second valve arrangement is moveable within a bore provided in a valve housing.

6. The fuel system as claimed in claim 5, wherein the second valve arrangement comprises a spool valve member, the bore provided in the valve housing and the spool valve member being shaped such that, when the spool valve member is in its first position, the bore and the spool valve member define a restricted flow path for fuel to be supplied to the injector and, when the spool valve member is in the second position, the bore and the spool valve member define a substantially unrestricted flow path for fuel to be supplied to the injector.

7. The fuel system as claimed in claim 6, wherein the spool valve member is of variable diameter along its axial length, the spool valve member including a first region of reduced diameter and a second region of enlarged diameter such that, when the spool valve member is in the first position the enlarged diameter region defines, together with the bore, the restricted flow path for fuel and, when the spool valve member is in the second position the reduced diameter region defines, together with the bore, the substantially unrestricted flow path for fuel.

8. The fuel system as claimed in claim 6, wherein the spool valve member is provided with flats which define, together with the bore, either the restricted flow path for fuel or the substantially unrestricted flow path for fuel depending on the position of the spool valve member.

9. The fuel system as claimed in claim 5, wherein the valve member is engageable with a first seating to control the rate of flow of fuel to the injector.

10. The fuel system as claimed in claim 9, wherein the second valve arrangement is arranged such that, when the valve member is in the first position it is seated against the first seating to prevent the flow of fuel therepast and, when the valve member is in the second position, it is spaced away from the first seating such that the bore and the valve member define a substantially unrestricted flow path for fuel through which high pressure fuel flows to the injector.

11. The fuel system as claimed in claim 10, wherein the second valve arrangement comprises a restricted flow path for fuel such that, when the valve member is in the first position seated against the first seating, fuel flows through the restricted flow path.

12. The fuel system as claimed in claim 11, wherein the restricted flow path is defined by a passage provided in the valve member.

13. The fuel system as claimed claim 1, wherein the second valve arrangement is actuable by means of hydraulic pressure acting on a surface associated with a valve member of the second valve arrangement to move the valve member between the first and second positions.

14. The fuel system as claimed in claim 1, wherein the actuator means comprises means for applying a force due to fuel pressure to the valve member of the second valve arrangement, and an additional valve for controlling the pressure of fuel applied.

15. The fuel system as claimed in claim 14, wherein the valve member of the second valve arrangement is urged towards the first position by means of a spring housed within a spring chamber for receiving fuel, the spring chamber communicating with a low pressure fuel reservoir through an the additional valve such that, upon movement of the valve member of the second valve arrangement away from the first position under the influence of fuel pressure, fuel is displaced to the low pressure fuel reservoir through the additional valve.

* * * * *